US005360168A

United States Patent [19]

McCue

[11] Patent Number: 5,360,168

[45] Date of Patent: Nov. 1, 1994

[54] FIRE HOSE SUPPORT

[76] Inventor: David N. McCue, R.R. 2, Carrying Place, Ontario, Canada, K0K 1L0

[21] Appl. No.: 991,088

[22] Filed: Dec. 14, 1992

[51] Int. Cl.[5] ..... B05B 9/00

[52] U.S. Cl. ..... 239/525

[58] Field of Search ..... 239/525–527, 239/444–449, 439, 440

[56] References Cited

U.S. PATENT DOCUMENTS

| | | | |
|---|---|---|---|
| 2,176,699 | 10/1939 | Anderson | 239/525 X |
| 2,289,352 | 7/1942 | Ensminger | 239/525 X |
| 2,919,071 | 12/1959 | Dalton | 239/525 X |
| 3,885,739 | 5/1975 | Tuttle | 239/526 X |
| 5,160,093 | 11/1992 | Battaglia | 239/525 X |
| 5,199,642 | 4/1993 | Rankin | 239/526 X |

FOREIGN PATENT DOCUMENTS

| | | | |
|---|---|---|---|
| 2804844 | 8/1979 | Germany | 239/526 |

*Primary Examiner*—Andres Kashnikow
*Assistant Examiner*—Kevin P. Weldon

[57] ABSTRACT

A support for a fire hose fitted between the hose and nozzle is provided with a brace and shoulder rest. The support provides for the deflection of water flowing through to the nozzle to be advanced forwardly of the rearward side of the user in order to reduce the tendency of the hose and nozzle to twist in the user's hands.

20 Claims, 5 Drawing Sheets

FIRE HOSE SUPPORT

FIELD OF THE INVENTION

This invention relates to a support or "brace"by which a fireman may more readily hold and direct a fire hose. More particularly, it relates to a support that will lessen the physical stress on a fireman in restraining himself against the thrust developed by a fire hose.

BACKGROUND OF THE INVENTION

A typical fire hose acting at a flow rate of 125 gallons/minute and a hydrant pressure of 110 psi will create a net rearward thrust that is on the order of 40 to 70 lbs. of force or more. This force must be resisted by a fireman holding the hose.

The effort required to control and contain such a hose is considerable. While the hose is on at full force, the thrust that must be absorbed is unremitting. Where a fireman is endeavouring to hold the hose directly in his hands, the muscles in the arms and hands of the fireman become fatigued. If a fireman's control over a hose declines sufficiently, a dangerous condition may arise when there is a risk that the hose may be dropped and thereby become freed to writhe and flail about.

Out of recognition of such risks a number of prior art patents have endeavoured to address this problem by providing firemen with devices to assist them in supporting a fire hose in operation:

U.S. Pat. No. 2,919,071—M. J. Dalton
U.S. Pat. No. 425,256—C. R. Robinson
U.S. Pat. No. 407,118—C. R. Robinson
U.S. Pat. No. 3,885,739—Phillip E. Tuttle
U.S. Pat. No. 1,829,621—G. L. Whiteford
U.S. Pat. No. 3,223,172—J. M. Moss
U.S. Pat. No. 5,052,624—Boers et al
U.S. Pat. No. 4,216,911—Huperz et al The two Robinson references show the use of attachments in the form of anchored supports, that allow the thrust of a hose to be partially transmitted to the earth by a strut or post. Such arrangements, however, are of limited use where a fireman is continually moving to better reposition himself.

Whiteford shows the use of a convertible bar that can serve as a strut, as in the Robinson references, or permit two firemen to share in supporting a hose nozzle. While chains are provided in Whiteford to carry the weight of the hose, no provision is made to assist the firemen in absorbing rearwardly-directed thrust.

Dalton depicts a hand held pistol grip that attaches to a fire hose just behind a nozzle, allowing a fireman to absorb the thrust of the hose through the palm of his hand, rather .than through a grasping action.

Tuttle, like Dalton, depicts a pistol-grip arrangement, with a finger-operated valve added.

Moss addresses the problem of transferring thrust by providing a harness to be worn by a fireman, a series of nozzles being attached directly to the harness. This arrangement, however, lacks the flexibility of hand-control over a hose nozzle.

Two patents not relating to the fire hose application of the present invention are those to Huperz and Boers.

Huperz shows a nozzle with a pistol-grip and trigger arrangement as in Tuttle. Water is allowed to enter this nozzle system through the grip or handle. A cushioned "shoulder or arm rest" (19) is also shown as extending rearwardly from the nozzle/pistol-grip assembly, in the form of a single rod terminating in a curved and padded butt-end, which presumably may rest against a fireman's shoulder.

Boers also shows a nozzle with pistol-grip and trigger, water being fed through to the nozzle by a substantially linear rearward extension from the nozzle. Above this extension, a "shoulder rest" (26) is mounted at the end of an arm (27) that extends downwardly to fasten to the rearward extension behind the nozzle.

Both Huperz and Boers include a shoulder rest as part of an integral triggered nozzle assembly. However, this arrangement, in both cases contemplates applications involving small diameter, pressurized water-jets used for cleaning, rather than fire hose systems. One distinction, therefore, between these applications and that of the case of a fire hose is that the weight of water contained within the fire hose and the thrust developed will be far greater than that which would be present in a washing-jet nozzle.

A feature of the Huperz disclosure is that the "stock" on his nozzle-support system is mounted in-line with the nozzle. This directs the rearward thrust of the water jet directly against the Shoulder of the fireman, without developing any twisting couple arising from such thrust. A twisting couple may, however, as is subsequently shown, arise from the deflection of water within the hose and support itself.

Further, the Huperz arrangement requires the nozzle-support system to be elevated to shoulder level—an arrangement which would be fatiguing to a fireman holding a fire hose. By reason of the height of which the jet-gun of Huperz must be raised off of the ground, this design, if converted to pipes of the diameter required for fire hoses, would burden a fireman with lifting a heavy length of hose and water high off of the ground.

In Boers, the shoulder rest is elevated above the reaction line of the nozzle, allowing the sprayer to be located below shoulder level. A very slight downward bend appears to be depicted in the drawings in the Boers sprayer, rearwardly of the shoulder bracing plate. No reference is made, however, to this bend in the written disclosure. Further, based on the normal proportions of a user of the Boer's device, the hose coupling at the rearward end would appear to be positioned at a point which is behind the vertical plane defined by the rearward side of the user. These features will be contrasted with those of the present invention, discussed subsequently.

None of these references acknowledge that water changing direction as it flows around a bend will create an outward thrust. Depending on the location of this thrust, a twisting force or "couple" may be developed. This will be apparent to a user endeavouring to hold the fire hose as a tendency for the hose nozzle to deflect vertically from the direction of intended use. In the case of a fire hose these forces would be substantial.

There is a need, therefore, for a simple but robust type of support that can be readily adapted for use with typical existing fire hoses and nozzles and which will allow a fireman to absorb both the thrust created by the fire hose against his torso, and the torques that tend to cause the hose to twist, thereby reducing the fatigue experienced by the hands and arms of the fire fighter.

The invention in its general form will first be described, and then its implementation in terms of specific embodiments will be detailed with reference to the drawings following hereafter.

These embodiments are intended to demonstrate the principle of the invention, and the manner of its implementation. Such embodiments represent one example of how the benefits of the invention may be obtained. Other means for achieving the same effects will be apparent from an examination of the operations of the elements of such preferred embodiments.

The invention will then be further described, and defined, in each of the individual claims which conclude this specification.

SUMMARY OF THE INVENTION

According to the invention in one of its preferred aspects, a fire hose support is provided for a user that comprises:

(1) a pipe section with couplings at its respective ends for attachment to a fire hose at one, hose end and to a fire hose nozzle at the other, nozzle end, such pipe section having a bend therein;

(2) a brace with a butt end, the brace being fastened to and angled upwardly from such pipe section, for resting against a user's shoulder at such butt end, wherein the bend in the pipe section is located forwardly of the butt end of the brace to thereby reduce the tendency of the fire hose support to deflect vertically when held by a user in the course of delivering water therefrom. Preferably, the hose end of the fire hose support which is provided with a coupling for connection to a fire hose should be located at a position that is no further rearwardly of a user than the vertical plane of the rearward side of the user.

Alternately, the hose support may be provided with a single straight pipe section having the hose end located at the place of and in lieu of the bend whereby water flowing into the hose support through a hose coupled thereto is deflected in its flow from an upward to a more nearly horizontal direction in the region located forward of the butt end of the brace.

More particularly, the fire hose support may comprise:

(1) a pipe section with couplings at its respective ends for attachment to a fire hose at one, hose end, and to a fire hose nozzle at the other, nozzle end, such section having a bend therein;

(2) a brace in the form of a first strut, attached to the pipe section in its forward region, proximate to its nozzle end, and extending rearward at an angle from the pipe section, such angle being preferably about 35° degrees, to terminate at the butt-end of the brace, the butt end having a shoulder-rest extending transversely to the first strut to provide a thrusting surface for bearing against the shoulder region of the body of a fireman; and (3) a second strut, attached to the pipe section at a position intermediate between the hose end of the pipe section and the attachment point of the first strut, such second strut extending outwards towards and being connected with the first strut at a position proximate to its butt-end portion, to thereby form an opening bounded by the first and second struts, and the pipe section by which opening a fireman may grasp the fire hose support.

By an optional feature of the invention, the pipe section may be bent by a small angle, preferably between 10° to 20° degrees, more preferably by about 15° degrees, in the region between the attachment points of the first and second struts to the pipe section and forwardly of the butt-end of the brace.

By a further preferred feature of the invention, the hose end of the hose support is located at a position which is forward of the vertical plane defined by the rearward side of the user.

As a further alternate design, the first and second struts may be formed integrally with a web that extends to the pipe section, which web is pierced by a hole to provide a handle, and optionally, by a hole to provide a wrench means to rotate the control rod of a fire hydrant.

By creating a fire hose support incorporating these features, a simple and inexpensive means is provided by which a fireman can easily pick-up the nozzle-end of a hose, grasping the support through the opening formed between the struts, and also provide a means by which the thrust of the fire hose can be absorbed against the torso of a fireman. The construction can be sufficiently robust to withstand the heavy handling necessary with fire hoses. At the same time, through use of standard threaded couplings at the ends of the pipe section, the fire hose support made according to the invention can be readily incorporated for use with existing hose and nozzle hardware.

In summarizing the invention above, and in describing the preferred embodiments below, specific elements have been described, and specific terminology has been resorted to for the sake of clarity. However, the invention is not intended to be limited to the specific terms so selected, and it is to be understood that each specific term and element includes all technical equivalents which operate in a similar manner to accomplish a similar purpose.

DESCRIPTION OF THE PREFERRED EMBODIMENTS

Figure 1:
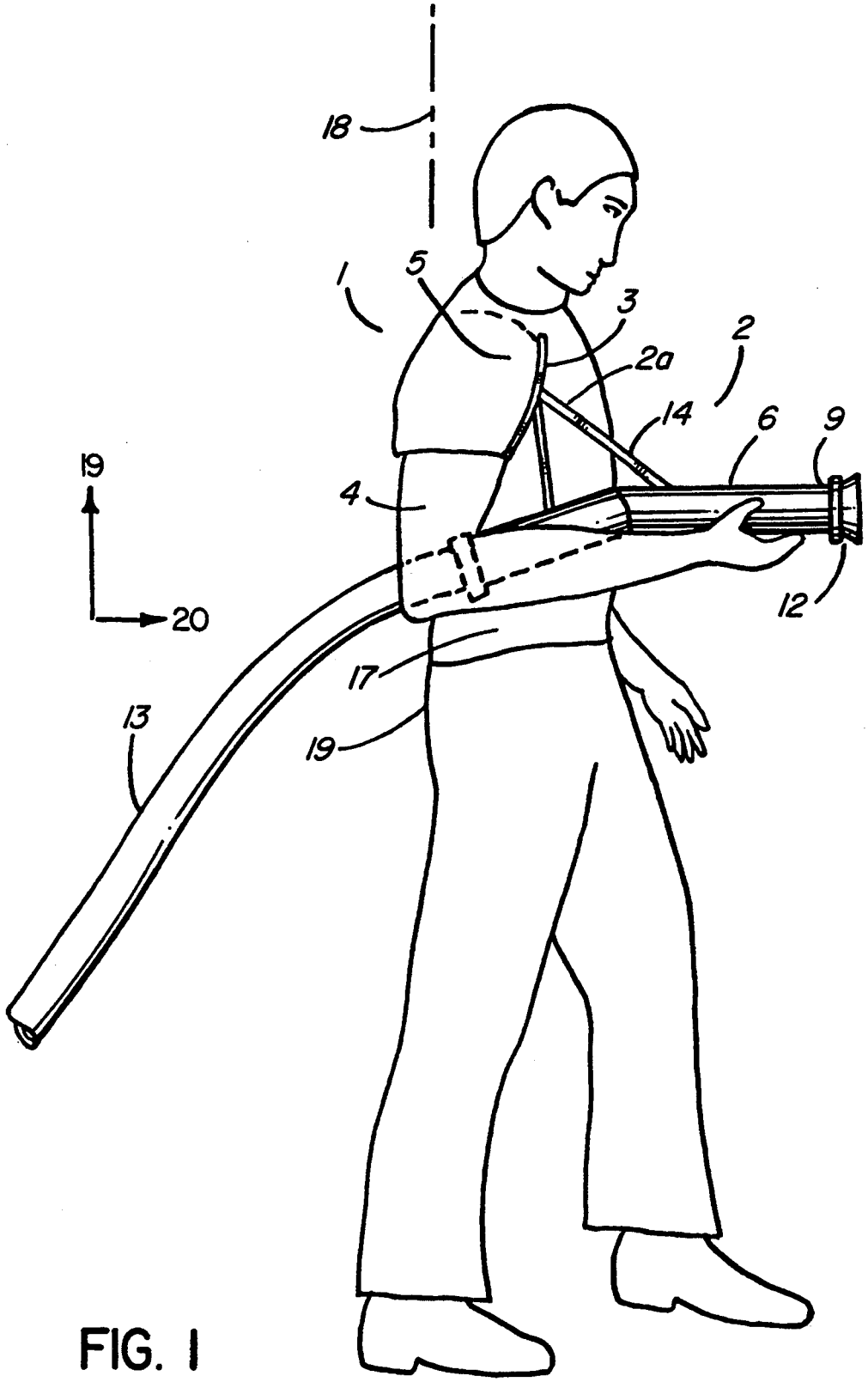
FIG. 1 shows a fireman holding a hose with nozzle that is equipped with one version of the fire hose support made in accordance with the invention.

In FIG. 1, a user/fireman 1 is shown holding the hose support 2 with the shoulder rest 3 on the butt-end 3*a* of the brace 2*a* pressed against his shoulder 5.

The hose support 2 has a pipe section 6 with a forward portion 7 and rearward portion 8. Preferably, the forward portion 7 is shorter than the rearward portion 8. These respectively terminate at the forward end 9 and rearward end 10 in couplings 11*a*, 11*b*. A nozzle 12 is attached at the forward coupling 11 and a hose 13 at the rearward coupling.

A first strut 14 extends from the shoulder rest 3 to the forward portion 7 of the pipe section 6. A second strut 15 extends from the shoulder rest 3 (or from the first strut 14 at a point proximate to the shoulder rest 3) to an intermediate location on the pipe section 6. A bend 16 is located in the pipe section 6 between the positions 14*a*, 15*a* where the first and second struts 14, 15 join to the pipe section 6.

Figure 2:
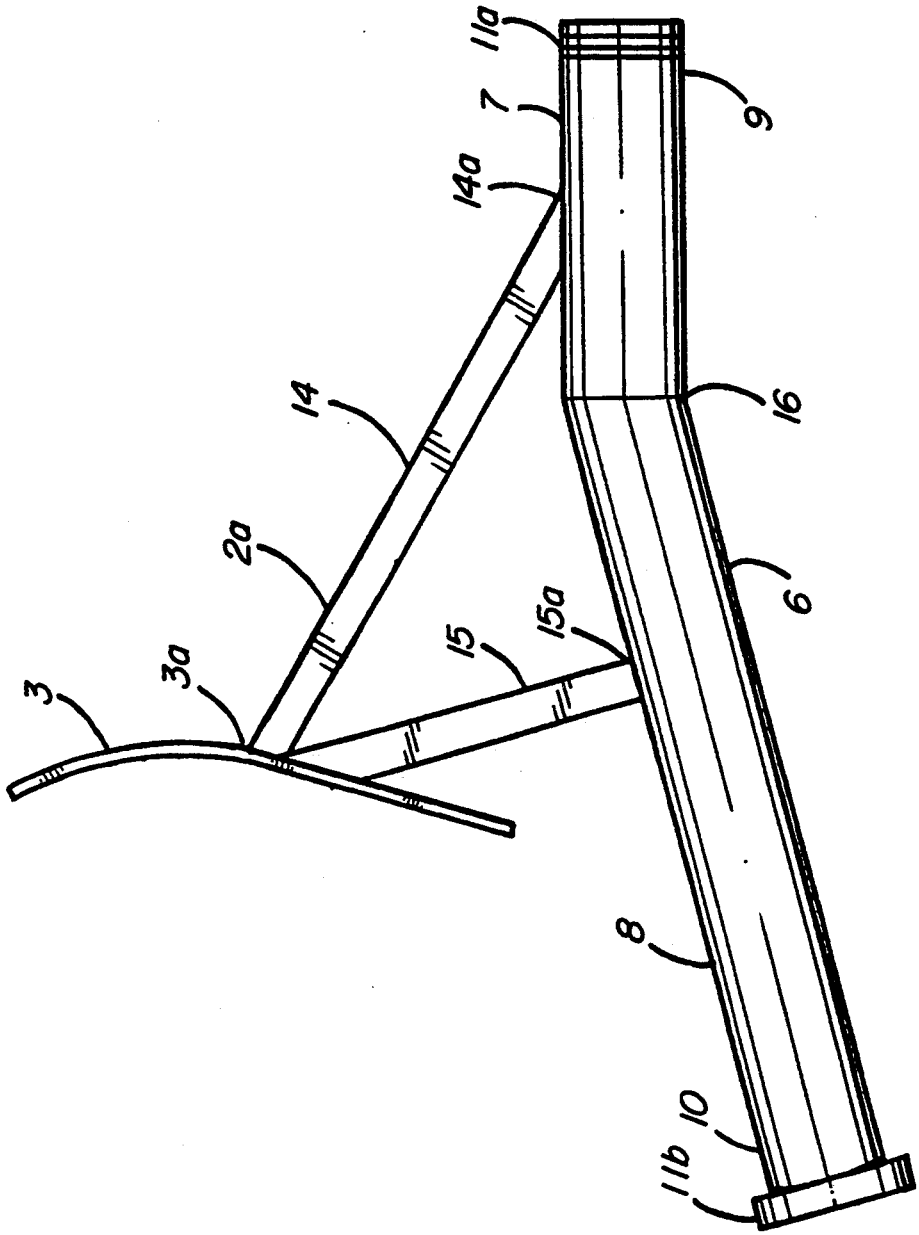
FIG. 2 is a side view of the fire hose support of FIG. 1 by itself.
Figure 8:
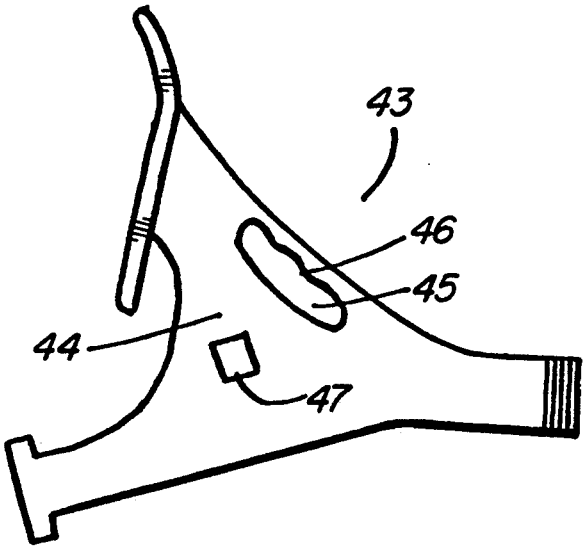
FIG. 8 shows an alternate webbed version of the hose support.

The angle of elevation of the first strut is about 30° degrees above the line of the forward portion 7 of the pipe section 6 and the rearward portion 8 is angled downwardly. This allows the rearward portion 8 of the pipe section 6 to lie along side the user 1, passing adjacent to or slightly above the location 17 of the hip bone of the user 1. In this position, the arm 4 of the user 1 may embrace the hose support 2, drawing it against his body with his elbow. An angle at the bend 16 of between 10° to 20° degrees, and preferably about 15° degrees has been found to achieve this effect when these elements are laid-out in the proportion as depicted in FIGS. 1, 2 and 8.

It will be seen from this arrangement that the bend 16 is positioned forward of the point of contact of the butt-end 3*a* of the brace 2*a* with the user's shoulder 5. The rearward end 10 of the pipe section 6 is located proximate to the vertical plane 18 that contacts the rearward side 19 of the torso of the user 1, and preferably just forward of this position.

The water in the hose 13 is deflected from a partially vertical direction 19 towards the horizontal direction 20 as it rises in the curve of the hose 13. It is also further deflected in this manner at the bend 16.

Preferably, a fireman would wish to stand with the hose behind him formed into a shallow "S" curve. If not fully upright, the forward-leaning "S" will provide some resistance to nozzle thrust. As well, the tendency of the hose 13 to straighten is reduced by this arrangement.

Figure 5:
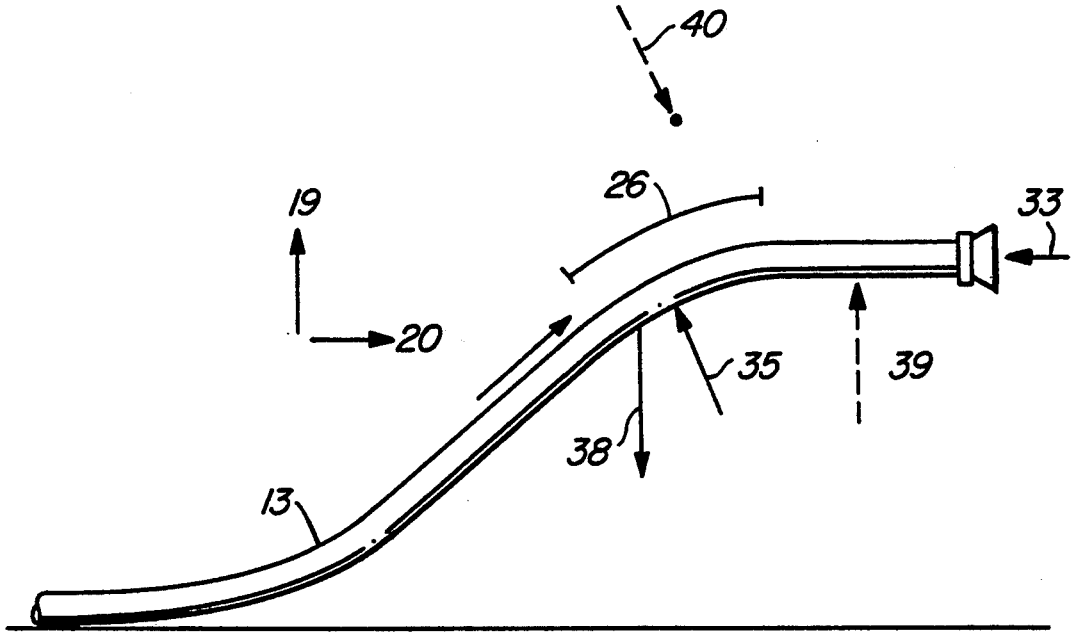
FIG. 5 is a forces diagram showing some of the forces believed to arise within a fire hose and nozzle on account of the flow of water passing therethrough.

The sources of the forces believed to affect a fire hose and nozzle are shown in FIG. 5. As the water is deflected in the curved, deflecting zone 26, an outward thrust is developed which may be resolved into a single outwardly and upwardly directed force vector 35. The centripetal force 35 of the water rounding the curve in the hose 13, the rearward thrust 33, and the weight 38 of the water in the fire hose 13 must all be balanced by the upward lifting force 39 applied by the user 1 and the thrust 40 developed at the butt-end 3*a* of the brace 2*a* through the shoulder 5 of the user 1. Ideally, the lifting force 39 should be minimized so that the user 1 may use his weight by leaning forward to generate the force 40.

Figure 6:
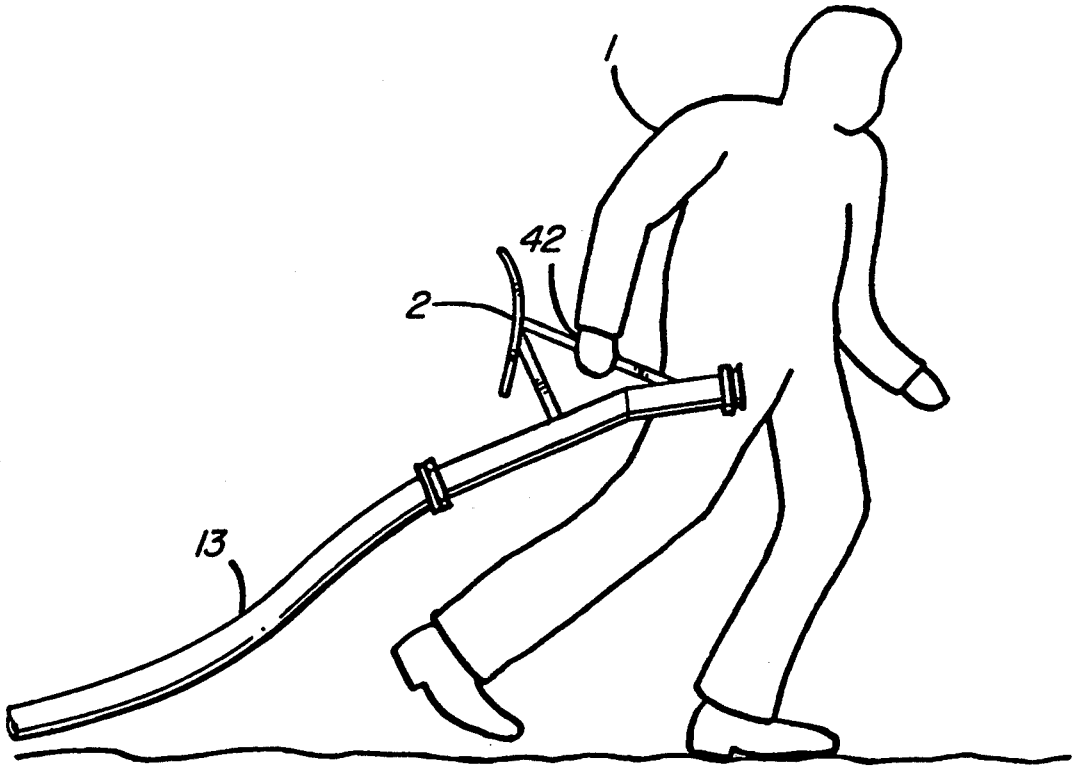
FIG. 6 depicts a fireman's hand using the fire hose support attached to a hose and nozzle as a means for grasping the hose.

A feature of the invention is that the preferred location for the flow of water to exit the upper deflecting zone 26 of the "S" curvature (as shown in FIGS. 1 and 6) is at a point that is shifted forwardly of the vertical plane 18 of the user's rearward side. Thus the net effective point of application of the force 35 arising from the deflection of the water is advanced forwardly to minimize the twisting effect or couple that the user 1 must apply to the hose 13 through his shoulder 5 and hands. This is believed to be the reason why the hose support 2 of the present invention has been seen to greatly increase the ease by which a user 1 may hold and control a fire hose 13.

Stated alternately it is desirable that the alignment of this thrust vector 35, combined with the other forces developed by the hose 13 and at the bend 16 in the hose support 2 pass as closely as possible to the center of the user's shoulder 5. If this total, net thrust is transmitted to the user's shoulder 5 through the shoulder rest 3 on the hose support 2 in approximate alignment with the shoulder 5, such an arrangement will reduce the tendency of the hose support 2 to twist under the influence of the forces created by the fire hose.

This effect is best achieved by providing for at least a portion of the water flow to be deflected from an upward direction 19 into a generally horizontal direction 20 at a location which is positioned forward of a user's shoulder 5, rather than behind the user 1. The location of the bend 16 as depicted in FIGS. 1 and 2 ensures that a portion of this deflection occurs forward of the vertical plane 18 of the user's rearward side, and preferably forward of the point where the butt-end 3*a* of the support 2 contacts the shoulder 5 of the user 1. This contributes to displacing the net thrust of the system forwardly.

The diagram of forces of FIG. 5 has been prepared only as a possible explanation for the improved performance of the invention. In fact, users employing this hose support 2 have experienced significantly less fatigue in holding a fire hose. This hose support allows a single fireman to hold a hose where previously two or more may have been required. This hose support also allows the momentary use of a single arm to control the hose, freeing a second arm for activities such as grasping railings while climbing stairs.

Figure 3:
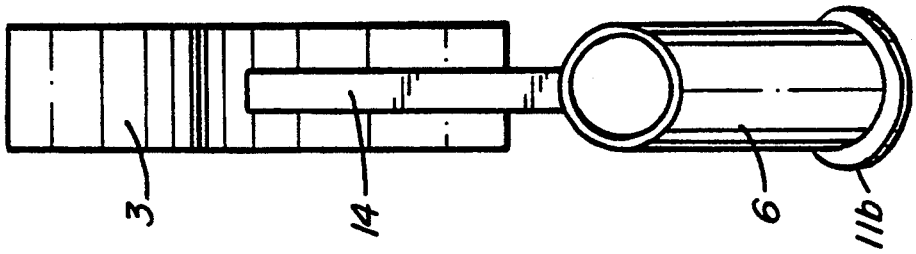
FIG. 3 is an end view of the hose support of FIGS. 1 and 2, taken from the nozzle end.
Figure 7:
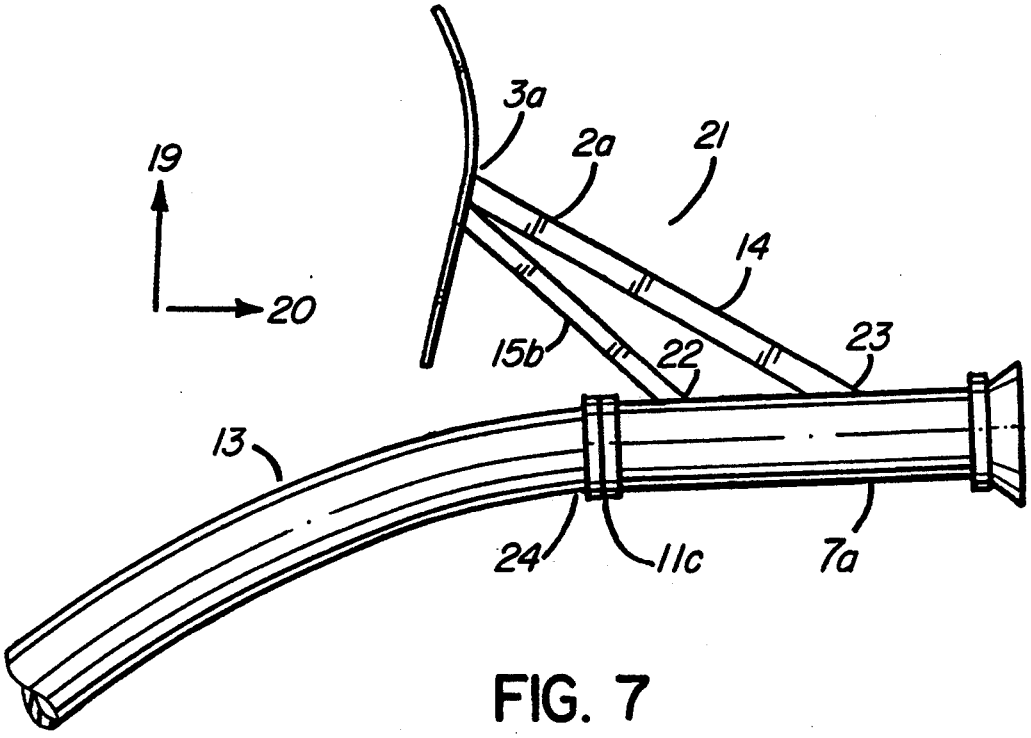
FIG. 7 shows an alternate, shortened version of the hose support of FIG. 2.

In FIG. 7 the prior rearward hose coupling 11*b* is shown advanced forwardly as a new coupling 11*c* in an alternate hose support design 21 that lacks the rearward portion 8 of the hose support design 2 of FIGS. 1–3. In such case, the support 2 may utilize a single first strut 14, or may have the second alternate strut 15*b* angled to join to the remaining pipe portion 7*a* at a location 22 rearwardly of the connection point 23 of the first strut 14.

The hose 13 in FIG. 7 thus joins to the alternate hose support 22 at a point 24 whereby the water flowing in the hose 13 is deflected from flowing in an upward direction into flowing in a horizontal direction 20 at a location that is located forwardly of the vertical plane 18 of the user's rearward side, and preferably forward of the butt-end of the shoulder brace 2*a*. This shifts the force vector 35 arising from the deflection of the water flow forwardly as well.

However, the convenience of having the rear portion 8 of the hose support 2 to clasp between the user's arm 4 and his body is lost in this configuration.

Figure 4A:
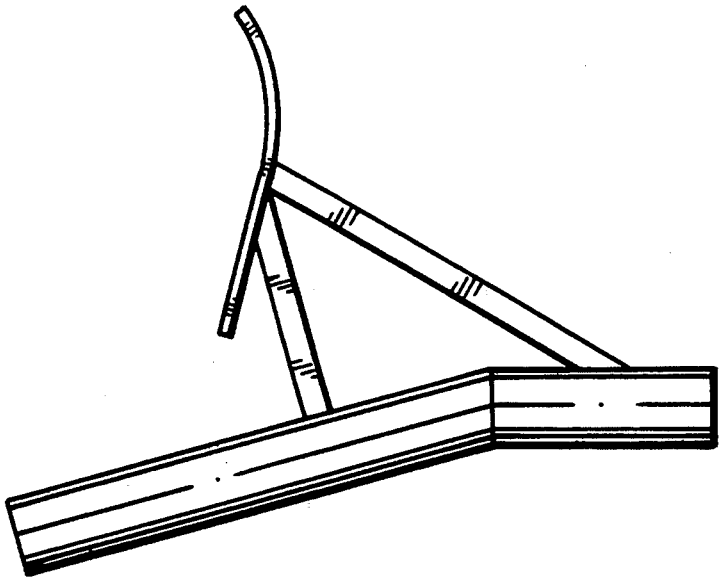
FIGS. 4*a* and 4*b* are comparative drawings showing both the hose support of the present invention and a depiction of the prior art device by Boers.
Figure 4B:
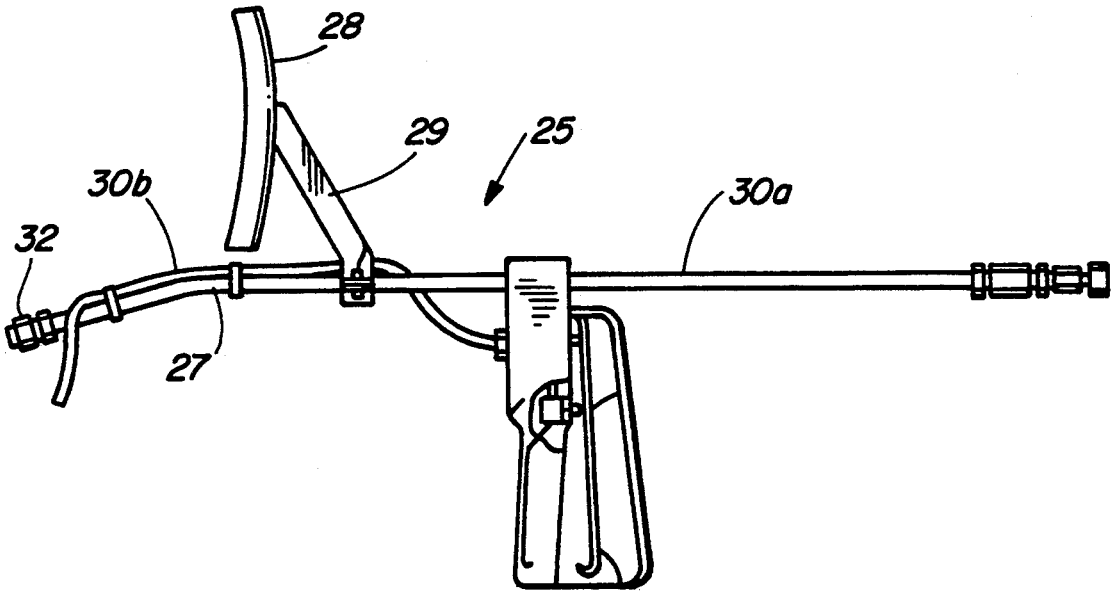
PRIOR ART FIG. 4b

In FIG. 4*b*, a depiction of the prior art Boers hose 25 support is shown beneath a preferred embodiment of the present invention (FIG. 4*a*). The inventor has tested a modified version of the Boers configuration. The gauge of pipe used for testing the Boers configuration was increased to the 1½ inches to function as a fire hose. It is to be noted from FIG. 4*b* that in the Boers device 25, the bend 27 is mounted rearwardly of the butt-end 28 of the bracing strut 29 as compared to the bend 16 of the hose support 2 of the present invention. In the modified version of Boers listed by the inventor the bend 27 was also located behind the shoulder rest.

These two units were tested using approximately the same pressure and flow rates (110 psi and 125 gallons/-minute).

The Boers-like design 25 was found to possess a greater angular inertia which made it more difficult for the fireman 1 to swing the nozzle left and right. It is believed that this was due particularly to the forward and rearwardly extending portions 30*a*, 30*b* of the Boers-like tool 25 which carried an additional mass of water to be swung at a distance from the pivoting axis of the fireman. Also, due to the rearwardly extending portion 30*b* of the Boers-like tool 25, when the fireman 1 decides to pivot, an increased length of rearwardly trailing, water-laden fire hose 13 had to be dragged over the ground. Further, the extended rearward location of the rearward coupling 32 on the Boers-like device 25 provided an extended lever arm that made the act of dragging the hose 13 more difficult. This would be a serious deficiency in hauling a hose up a stairs.

A further distinction in performance between the Boers-like model 25 and the present invention 2 is that the Boers device 25 felt heavier to hold. This is believed to be due partly from the increased mass of water being held off the ground rearwardly of the fireman; and by the fact that the most of water entering the Boers-like tool 25 was deflected from an upward angle of travel into a horizontal flow at a point that was positioned rearwardly of the shoulder 5 of the fireman. This placed the resulting force vector 35 in Boers at a position which is more to the rearward of the user.

In the case of the present invention, at least a significant portion of the water flow is deflected into a generally horizontal direction within the region which is located forward of the rearward plane 18 of the user 1. This condition is believed to be the source of the observed tendency of the inventive hose support 2 to thrust the shoulder rest 3 upwardly into the shoulder 5 of the user 1. This assists the user 1 greatly in holding the hose 13 and support 2 in place. By way of contrast, the Boers-like configuration 25 showed a reduced tendency to lift the hose support 2 towards the shoulder 5.

The preferred design of the hose support 2 allows a user 1 to grasp and pull on the support 2 by one hand 42, when the waterflow is shut off. This provides a convenient means for dragging hose 13 into position. This is depicted in FIG. 6.

A further alternate version of the hose support 43 is shown in FIG. 8. This further alternate version 43 contains a solid web 44 within the space normally defined by the struts 14, 15 and pipe section 6. This web 44 may be pierced by an opening 45 to provide a handle 46 along the border corresponding to the forward strut 14. As well, a hole 47, shaped to engage the rectangular control rod end on a fire hydrant, may also be provided within the web 44 to increase the utility of this device as a tool for opening the water flow at a hydrant.

Conclusion

The foregoing has constituted a description of specific embodiments showing how the invention may be applied and put into use. These embodiments are only exemplary. The invention in its broadest, and more specific aspects, is further described and defined in the claims which now follow.

I claim:

1. A hose support for use by a user in supporting a nozzle mounted at the end of a hose comprises:

(1) a pipe section with couplings at its respective ends for attachment to a hose at one, rearward, hose end, and to a hose nozzle at the other, forward, nozzle end, such pipe section having a downwardly inclined bend therein proceeding rearwardly towards the hose end;

(2) a brace with a butt end for resting against a user's shoulder, the brace being fastened to and angled upwardly from such pipe section at the brace's opposite end to such butt end, wherein the bend in the pipe section is less than 90° degrees and is located forwardly of the butt end of the brace to thereby reduce the tendency of the hose support to deflect vertically when held by a user in the course of delivering fluid therefrom.

2. A hose support as in claim 1 wherein in the coupling located at the hose end of the hose support is located at a position that is no further rearwardly of a user than the vertical plane of the rearward side of the torso of the user.

3. A hose support as in claim 2 wherein the angle of the bend is between 10° and 20° degrees.

4. A hose support as in claim 1, wherein the hose end of the hose support is located at a position which is forward of the vertical plane defined by the rearward side of the torso of the user.

5. A hose support as in claim 1 wherein the angle of the bend is between 10° and 20° degrees.

6. A hose support as in claim 1, wherein the first and second struts are formed integrally with a web that extends to the pipe section, which web is pierced by a hole to provide a handle.

7. A hose support as in claim 6 wherein the web is pierced by a hole to provide a wrench means to rotate the control rod of a fire hydrant.

8. A hose support in combination with a hose, that extends upwardly and forwardly from the ground comprising:

(a) a horizontally positioned straight pipe section having a nozzle end and a hose end to which the hose is connected;

(b) a brace means extending upwardly from the pipe section at an angle to terminate at a butt end for resting against a user's shoulder wherein the hose end of the pipe section is located forwardly of the butt end of the brace whereby fluid flowing into the hose support through the hose is deflected in its flow through an angle of less than 90° degrees, from an upward to a more nearly horizontal direction in the region located below the shoulder of the user.

9. A hose and support as in claim 8 wherein deflection of the fluid occurs substantially forward of the butt end of the brace.

10. A hose support as in claim 8, wherein the hose end of the hose support is located at a position which is forward of the vertical plane defined by the rearward side of the torso of the user.

11. A hose support as in claim 8, wherein the first and second struts are formed integrally with a web that extends to the pipe section, which web is pierced by a hole to provide a handle.

12. A hose support as in claim 11 wherein the web is pierced by a hole to provide a wrench means to rotate the control rod of a fire hydrant.

13. A hose support for use by a user in supporting a nozzle mounted at the end of a hose comprising:

(1) a pipe section with couplings at its respective ends for attachment to a hose at one, hose end, and to a hose nozzle at the other, nozzle end, such section having a downwardly inclined bend therein proceeding towards the hose end;

(2) a brace in the form of a first strut, attached to the pipe section in its forward region, proximate to its nozzle end, and extending rearward at an angle from the pipe section, to terminate at the butt-end of the brace, the butt end having a shoulder-rest extending transversely to the first strut to provide a thrusting surface for bearing against the shoulder region of the body of a user; and (3) a second strut, attached to the pipe section at a position intermediate between the hose end of the pipe section and the attachment point of the first strut, such second strut extending outwards towards and being connected with the first strut at a position proximate said butt-end of the brace, to thereby form an opening bounded by the first and second struts, and the pipe section by which opening a fireman may grasp the first hose support;

wherein the bend in the pipe section is less than 90° degrees and is located forwardly of the butt end of the brace to thereby reduce the tendency of the hose support to deflect vertically when held by a user in the course of delivering fluid therefrom.

14. A hose support as in claim 13 wherein the bend is located between the attachment points of the first and second struts to the pipe section and forwardly of the butt-end of the brace.

15. A hose support as in claim 13 wherein the size of the angle between the first strut and the forward region of the pipe section is about 30° degrees.

16. A hose support as in claim 13, wherein the hose end of the hose support is located at a position which is forward of the vertical plane defined by the rearward side of the torso of the user.

17. A hose support as in claim 13 wherein the angle of the bend is between 10° and 20° degrees.

18. A hose support as in claim 17 wherein the angle of the bend is about 15° degrees.

19. A hose support as in claim 13, wherein the first and second struts are formed integrally with a web that extends to the pipe section, which web is pierced by a hole to provide a handle.

20. A hose support as in claim 19 wherein the web is pierced by a hole to provide a wrench means to rotate the control rod of a fire hydrant.

* * * * *